United States Patent [19]

Huckaby

[11] 4,047,853

[45] Sept. 13, 1977

[54] HYDRAULIC UNLOADING AND CIRCULATING DEVICE

[76] Inventor: Leonard Huckaby, P.O. Box 152, Wayne, Okla. 73095

[21] Appl. No.: 741,944

[22] Filed: Nov. 15, 1976

[51] Int. Cl.[2] ..... F04B 39/12; F04B 21/00

[52] U.S. Cl. ..... 417/434; 417/554

[58] Field of Search ..... 417/434; 417/545, 552–554

[56] References Cited

U.S. PATENT DOCUMENTS

| | | | |
|---|---|---|---|
| 1,672,687 | 6/1928 | Penrod | 417/434 |
| 1,801,209 | 4/1931 | Roark | 417/434 |
| 3,384,179 | 5/1968 | Haines | 417/554 |
| 3,448,805 | 6/1969 | Brown | 417/434 |
| 3,990,509 | 11/1976 | Hodgecock | 417/434 |

*Primary Examiner*—William L. Freeh

*Attorney, Agent, or Firm*—Ralph B. Pastoriza

[57] ABSTRACT

The hydraulic unloading and circulating device is adapted to be inserted in a threaded joint of a well tool connected to sucker rods and including a pumping tube surrounding said tool and supported on the end of a pipe string through which said sucker rods extend, for passing fluid between the exterior of the tool and interior of the pumping tube and pipe string to the interior of the tool and well annulus to thereby relieve the difference of hydrostatic pressure between fluid in the well annulus and interior of the pumping tube and pipe string. The device itself includes a housing with a telescoping mandrel having a straight through passage and lateral port, which, when the mandrel is telescoped in the housing to a first telescoped position, the port is eclipsed and when the mandrel is telescoped upwardly from the housing to a second telescoped position, the port is exposed to thereby effect communication between fluid in the pipe string and the well annulus. Before the mandrel can be moved to its second telescoped position to effect the hydraulic static pressure equalization, it must be rotated through a given number of degrees.

4 Claims, 6 Drawing Figures

HYDRAULIC UNLOADING AND CIRCULATING DEVICE

This invention relates generally to devices for use in oil wells and more particularly, to an improved hydraulic unloading and circulating device adapted to be inserted within the threaded joint of a well tool such as a pump supported on the end of a pipe string for passing fluid from the interior of the well pipe string to the exterior well annulus thereby equalizing hydrostatic pressure.

BACKGROUND OF THE INVENTION

In order to pump oil from a well in which casing has been set, the casing is perforated by a suitable gun at those levels in which oil has been indicated to exist. After the casing has been perforated, a pumping tube is lowered on the end of the conventional drill pipe string to this particular level and within the pumping tube itself there is then lowered a pumping apparatus or tool. The lower interior of the pumping tube terminates in an annular seat adapted to receive in sealing relationship the lower end of the pumping apparatus. The pumping apparatus itself is operated by sucker rods which pass up through the pumping tube and pipe string and are reciprocated to operate a plunger within the pumping apparatus. Oil may thus be pumped through the perforations in the casing and up past the lower annular seat of the pumping tube through the pumping apparatus and thence upwardly through the pipe string to the surface of the well.

After pumping has been completed or if it is desired to change the pump or repair it, it is necessary to unseat the lower end of the pumping apparatus or tool from the annular seat defined by the pumping tube. Since, however, the pumping apparatus as well as the tube itself and the pipe string is filled with oil throughout the length of the pipe string, whereas the surrounding fluid in the well annulus defined between the exterior of the pumping tube and the interior of the casing is at a relatively low level, there exists a very large pressure differential rendering it extremely difficult to unseat the pump from the annular seat of the pumping tube. In fact, the sucker rods themselves through which the pulling forces apply to the pumping apparatus may very well break before sufficient force is applied to unseat the pump.

The foregoing condition may be overcome if the fluid within the pipe string and surrounding the pumping apparatus within the pumping tube could be passed in a reverse direction through the pump tool and out the lower end thereof past the seat the the annulus exterior of the pumping tube. If the fluid could be passed in this manner, the large hydrostatic head created within the pumping apparatus and pipe string could be "dumped" into the surrounding annulus of the well and thus equalize the pressures involved so that removal of the pumping apparatus from the annular seat could be very readily achieved.

It is important in a device of the foregoing type that the hydraulic unloading of the fluid within the pipe string to the exterior annulus would only operate in the event a force greater than that which might damage the sucker rods would be required to unseat the pumping apparatus; otherwise, inadvertent equalization of the hydrostatic pressures might occur during normal pumping.

In other instances of pumping operations, the pump tool itself may become stuck in the bore hole and in such event, it would be desirable to remove at least a portion the tool so that suitable fishing equipment could be brought in to remove the stuck portion.

In my U.S. Pat. No. 3,168,873 issued Feb. 9, 1965, there is disclosed a hydraulic unloading and circulating device which solves the foregoing problems. Essentially, this device provides a housing cooperating with a mandrel partially telescoped within the housing. The mandrel itself includes a straight through fluid passage having a lateral port which, when the mandrel is in a first telescoped position, is eclipsed by the housing so that no fluid can pass through the lateral port. However, when the mandrel is telescoped outwardly to a second position, a lateral port is exposed so that there is provided a passage for fluid from the exterior of the device to the interior straight through passage.

The lower end of the housing terminates in threads adapted to be threaded to the lower threads of a threaded joint in the oil well pump tool itself below the normal ball valve head. The upper end of the mandrel, in turn, is coupled to the upper threads of the threaded joint of the tool.

Shear pins are provided to hold the mandrel in its first telescoped position in the housing so that the lateral port is normally eclipsed and normal pumping operations can ent force is exerted on the rods to shear the shear pins and thus permit the mandrel to telescope upwardly to its second telescoped position thereby placing the respective fluids in communication with each other so that the pressures are equalized. The pump can then readily be removed from the lower annular seat of the pumping tube since it is no longer held thereon by the hydrostatic pressure of fluid in the pipe string.

While the foregoing tool as described has been satisfactory, there is still room for improvement in such a device. More particularly, it would be desirable if the device could be designed so as to avoid the necessity of having to replace shear pins each time the device is to be used.

BRIEF DESCRIPTION OF THE PRESENT INVENTION

With all of the foregoing considerations in mind, the present invention contemplates an improved hydraulic unloading and circulating device similar in most respects to the heretofore referred to device described in my above-mentioned U.S. Pat. No. 3,168,873 but utilizing in lieu of shear pins, a unique structural arrangement permitting appropriate use without damage to any parts as was the case when shear pins were used.

More particularly, rather than shear pins, in accord with the present invention a sleeve is provided in the lower portion of the housing having cut-out wall portions defining vertical guide channels of given circumferential width, the lower end of the mandrel being received in the sleeve and having radially extending lugs of given circumferential extent receivable in the channels. With this arrangement, upward and downward telescoping movements of the mandrel between its first and second telescoped positions to respectively eclipse and expose the lateral ports, is guided by the guide channels.

The lower end of the sleeve between the channels is spaced above the lower end of the mandrel when the mandrel is in its first telescoped position so that rotation of the mandrel through a given number of degrees positions the lugs beneath the lower end of the sleeve to thereby lock the mandrel against pulling movement when in its rotated position.

The basic components of the improved assembly include a torque spring connected between the mandrel and the housing to exert a circumferentially directed biasing force on the mandrel in a rotational direction to position the lugs beneath the lower ends of the sleeve. With this arrangement, intentional rotation of the sucker rods from the surface of the well through the given number of degrees in a rotational direction opposite to the bias of the torque spring positions the lugs through the upper threaded connection of the mandrel to the upper portion of the pump tube in the channels and subsequent upward pulling on the sucker rods from the surface of the well moves the mandrel to its second telescoped position thereby exposing the port and placing fluid in the pump tube in communication with fluid in the annulus of the well.

Subsequent downward movement of the mandrel is guided by the channels until the lower end of the lugs pass the lower end of the sleeve after which the torque spring will snap the mandrel into its rotative locked position automatically.

BRIEF DESCRIPTION OF THE DRAWINGS

A better understanding of this invention will be had by now referring to the accompanying drawings in which.

DETAILED DESCRIPTION OF THE INVENTION

Figure 1:
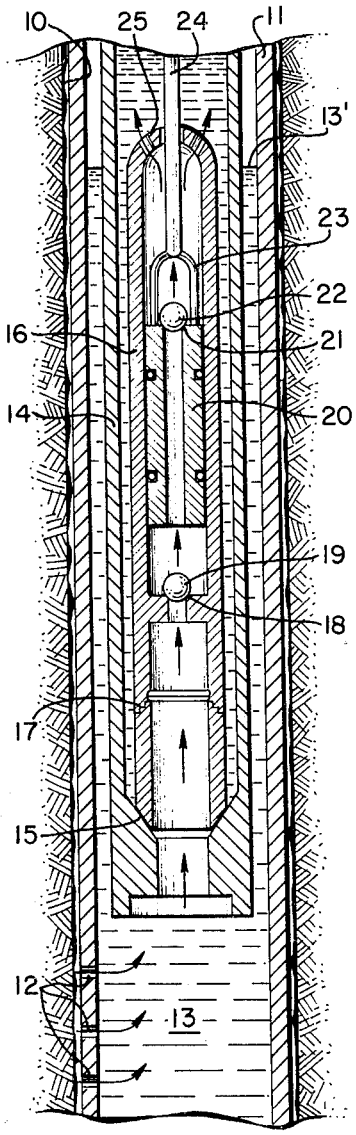
FIG. 1 is a cross section of a pumping unit positioned in an oil well bore hole for pumping oil therefrom.

Referring first to FIG. 1, there is shown an oil well bore hole 10 within which casing 11 has been positioned. As shown in the lower left portion of FIG. 1, the casing 11 has been perforated as at 12 to admit oil from the surrounding formations to the interior of the casing. This oil is designated by the numeral 13. When pumping is required to remove the oil, the pressure of oil passing through the perforations 12 is not great and therefore the oil level within the casing annulus may be relatively low, such as indicated by the level line 13'.

To pump the oil 13 to the surface, there is first lowered a pumping tube 14 terminating at its lower inner end in an annular seat 15. This seat 15 in turn is arranged to cooperate with a pumping apparatus or tool including a pump barrel 16. The lower end of the pump barrel 16 seats in sealing relationship on the seat 15 and includes a threaded joint as indicated at 17 generally relatively close to the seated end. Within the pump barrel 16, there is included a lower annular seat 18 and ball valve 19. A plunger 20 is positioned above the ball 19 and itself includes at its upper end an annular seat 21 and a second ball valve 22. The upper end of the plunger 20 is coupled by a spider structure 23 to sucker rods 24 so that the plunger may be moved in an up and down direction. Small ports 25 are provided at the upper end of the pump barrel 16 so that oil pumped up by movement of the plunger 20 will pass upwardly to the surface of the bore hole through the pumping tube 14 and drill pipe string to which the pumping tube 14 is connected.

Thus, in the operation of the pump described in FIG. 1, upward movement of the plunger 20 by pulling on the sucker rods 24 will result in the ball 19 unseating from the seat 18 and oil passing upwardly within the pumping head 16 above the ball 19. Subsequent downward movement of the plunger 20 will then close the ball 19 on the seat 18 and thus the oil entrapped will be forced past the ball 22 which will be unseated from the seat 21. The next upward movement of the plunger 20 will then lift this oil out through the opening 25 and up through the pumping tube 14 and pipe string to the surface of the well.

When it is desired to remove the pump barrel 16, it is normal practice to simply pull on the sucker rods 24 until the lower end of the barrel is unseated from the annular seat 15 of the pumping tube 14. The entire pumping apparatus may then be raised to the surface of the bore hole. However, since the pressure exerted on the pump barrel 16 by the hydrostatic head of oil within the pumping tube 14 and pipe string is considerably greater than the pressure of the oil 13 within the annulus defined between the casing 11 and exterior of the pumping tube 14, the pump barrel 16 is held by hydrostatic pressure on the seat 15. In other words, the pressure exerted up through the lower end of the pumping tube 14 past the annular seat 15 is very low since the height of the oil indicated by the level line 13' is relatively low, whereas the pressure on the upper side of the pump unit is extremely high because of the tremendous hydrostatic head of the oil extending to the surface of the bore hole.

If the aforementioned hydrostatic head of oil within the pumping tube 14 and pipe string could be relieved by passing the oil within the tube to the exterior of the pumping apparatus; that is, to the annulus, it would be very easy to unseat the pump barrel 16 from the annular seat 15.

Figure 2:
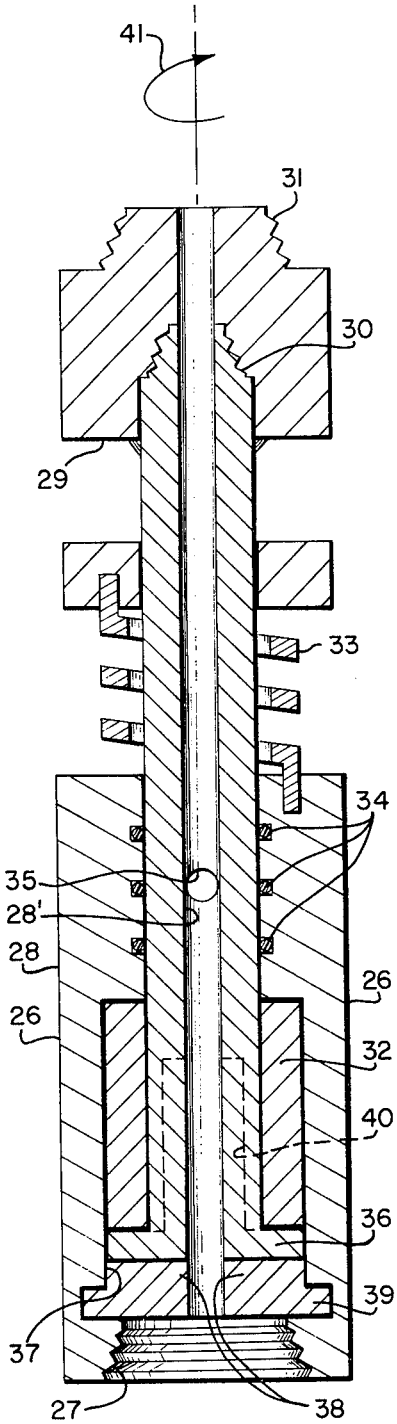
FIG. 2 is an enlarged cross section illustrating the improved hydraulic unloading and circulating device of this invention adapted to be inserted within a threaded joint of the tool shown in FIG. 1 and wherein the components of the device are in a first telescoped position.
Figure 3:
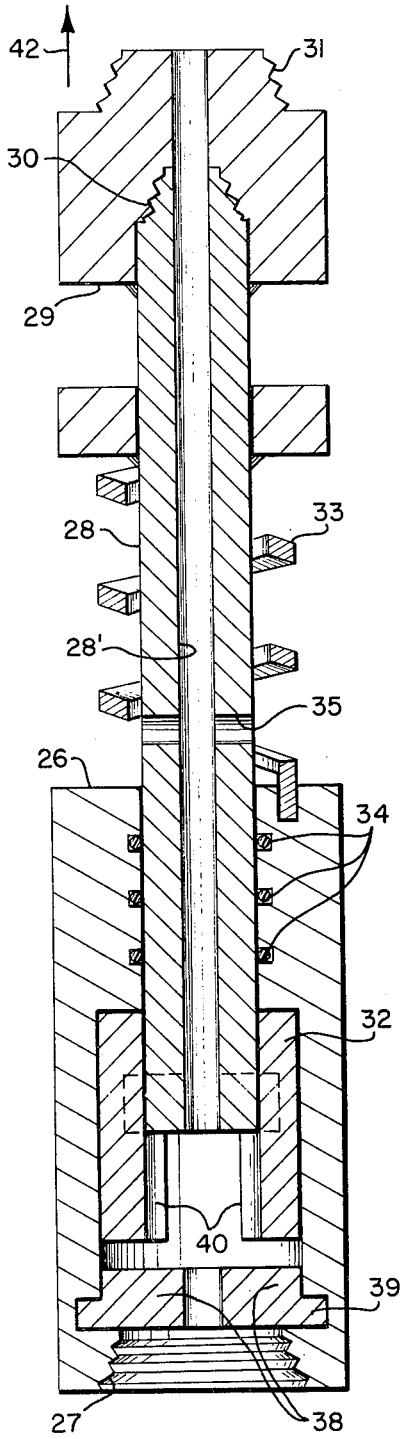
FIG. 3 is a view similar to FIG. 2, but illustrating the components of the device in a second telescoped position to effect a hydraulic unloading operation.

In accordance with the instant invention, this hydraulic unloading is achieved by inserting a device in the threaded joint 17 of the pump barrel 16. This device is illustrated in FIGS. 2 and 3 and as shown, includes a housing 26 terminating at its lower end in threads 27 adapted to be threadedly connected to the lower threads of the joint 17 of the pump barrel 16 of FIG. 1. Cooperating with the housing 26 is a mandrel 28 partially telescoped therein as shown and including an internal straight through passage 28'. Mandrel 28 terminates at its upper end in coupling 29, the lower end of this coupling 29 having left hand threads 30 cooperating with the left hand threads on the upper end of the mandrel 28. The upper end of the coupling 29 includes conventional threads 31 for threaded connection to the upper threads of the joint 17. By this arrangement, the device may readily be inserted within the joint 17 so as to constitute part of the pump barrel 16 without modifying the pump barrel.

As shown in FIG. 2, the lower inner portion of the housing 26 includes a sleeve 32 surrounding the lower end of the mandrel 28. As will become clearer as the description proceeds, the sleeve 32 has opposite cut-out wall portions defining guide tracks for telescoping movement of the mandrel 28 relative to the housing 26. Also shown in FIG. 2 is a torque spring 33 connected at one end to the housing 26 and at its other end to an appropriate collar secured to the mandrel 28. This torque spring exerts a rotational bias on the mandrel relative to the housing 26, the purpose for which will also become clearer as the description proceeds.

Between the mandrel 28 and upper portion of the housing 26 telescopically receiving the mandrel, there are provided sealing O-rings 34. These O-rings are of a composition to withstand high temperature and may constitute steel hydraulic rings. It will be noted in FIG. 2 that these O-rings are above and below a lateral port 35 communicating with the straight through passage 28' and the mandrel 26. Any fluid ingress or egress from this port 35 is thus blocked by the O-rings when the mandrel 28 is in the telescoped position which constitutes a first telescoped position illustrated in FIG. 2.

Referring now to the lower portion of the mandrel 28 in FIG. 2, it will be noted that this lower end includes radially extending sector shaped lugs 36 received under the lower ends of the sleeve 32 when in the rotative position illustrated. In addition, the lower end of the mandrel 28 includes a sector shaped cavity 37 cooperating with projections 38 from a plate 39 constituting a clutch means. The plate 39 is anchored in the housing 26 as shown.

The projections 38 on the clutch and the cavity 37 is so shaped as to permit rotation of the mandrel 28 within the housing 26 through a given number of degrees. This rotation is sufficient to position the radially extending sector lugs 36 on the end of the mandrel beneath the open cut-out wall portions of the sleeve 32 one such cut-out portion being indicated by the dashed lines 40 in FIG. 2.

Thus, referring to both FIGS. 2 and 3, when the mandrel 28 is rotated in a clockwise direction looking down from the top as indicated by the arrow 41 through a 90° angle, the lugs 36 will fall under the cut-out wall portions of the sleeve 32, these cut-out wall portions defining guiding channels as described heretofore so that the lugs can ride up in these channels and permit upward telescoping movement of the mandrel relative to the housing 26. This upward telescoping movement is indicated in FIG. 3 wherein the mandrel 28 has been telescoped to a second position after the rotation, the upward movement being indicated by the arrow 42 at the top of FIG. 3.

In the second position illustrated in FIG. 3, the cut-out wall defining the channel 40 is now visible in the lower portion of FIG. 3. Further, the movement to the second telescoped position has been sufficient to expose the lateral port 35 thus providing communication between the interior of the pumping tube 14 of FIG. 1 and the exterior of the mandrel 28 and housing 26 through the port 35 and down the straight through passage 28' to the annulus of the well between the casing 11 and pumping tube 14. This communication will be appreciated by reference to FIG. 1 when it is recalled that the device of FIG. 3 is threaded into the joint 17. The torque spring 33 described in FIG. 2 exerts a return bias force from the rotated position of FIG. 3 of the mandrel back towards the rotated position of FIG. 2. Thus, when the mandrel is urged downwardly relative to the housing 26, the downward movement will be guided by the lugs 38 in the channels of the sleeve until the lugs pass below the ends of the sleeve after which the torque spring 33 will cause a 90° rotation to bring the lugs underneath the lower ends of the sleeve 32 to the position illustrated in FIG. 2. In this position, it will be evident that the mandrel is locked against upwardly telescoping movement relative to the housing.

The sleeve 32, lugs 36 on the end of the mandrel, and the torque spring 33 function essentially to replace shear pins utilized in applicant's heretofore referred to U.S. patent and provide the advantage of avoiding the necessity of replacing shear pins after the device has been operated.

Figure 4:
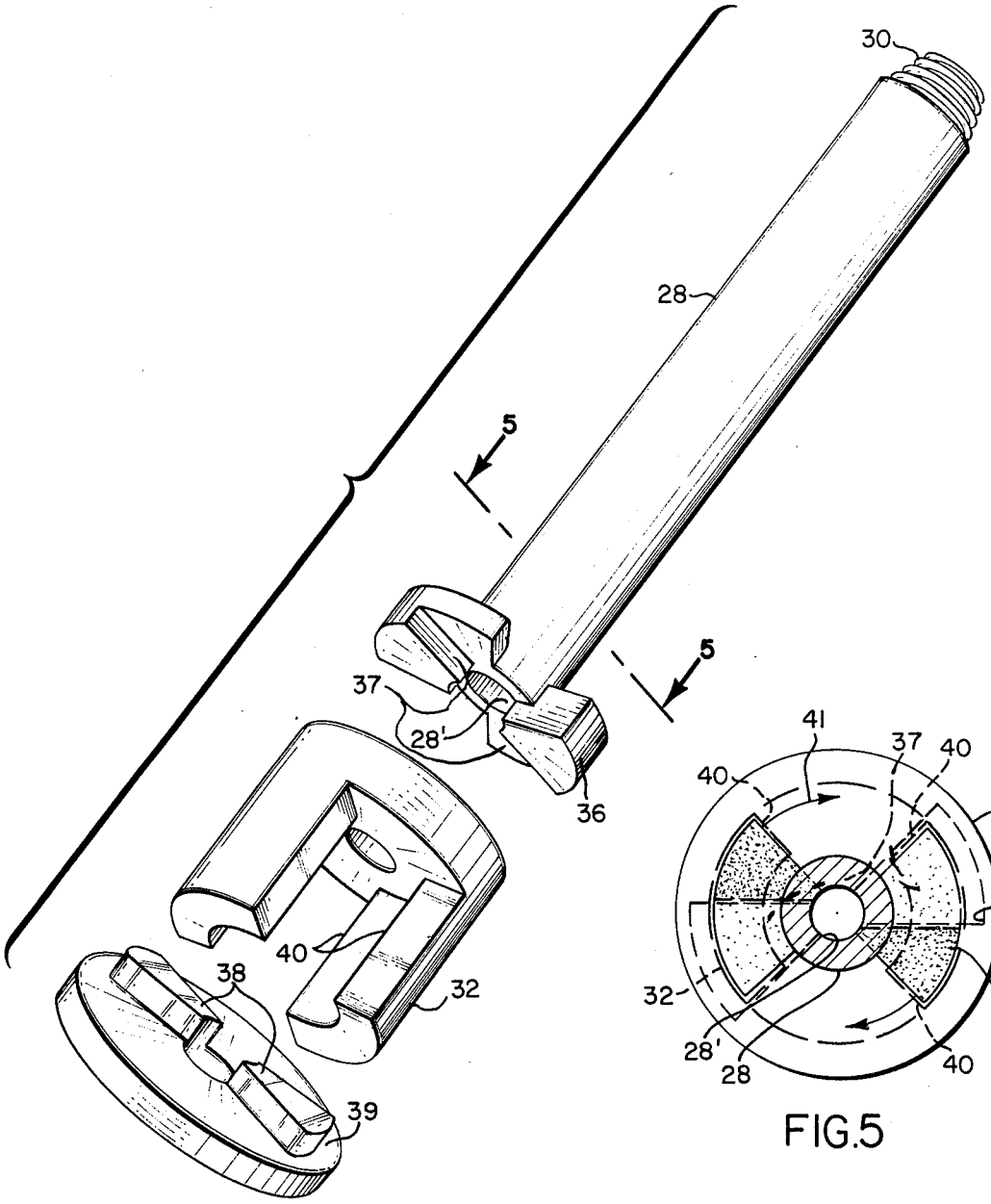
FIG. 4 is an exploded perspective view of certain of the basic components utilized in the device of FIGS. 2 and 3.
Figure 5:
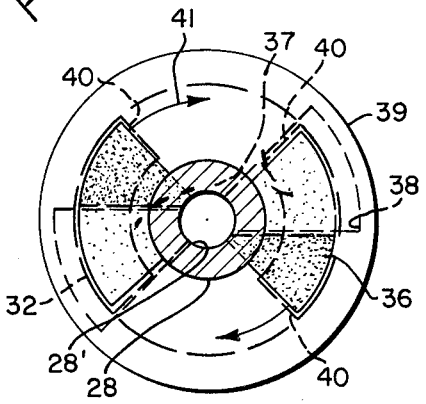
FIG. 5 is a plan view highly schematic in nature of the relative positions of components looking in the direction of the arrows 5—5 corresponding to those of FIG. 2; and, FIG. 6 is a view similar to FIG. 5 but illustrating the relative positions of components corresponding to that of FIG. 3.
Figure 6:
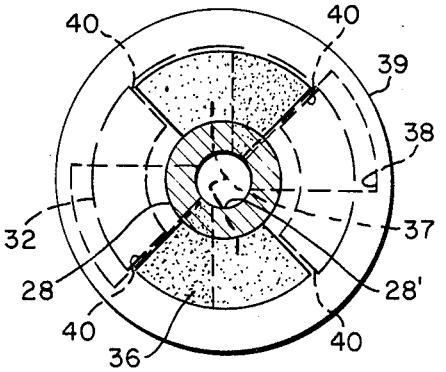

All of the foregoing can be better understood by referring to the schematic diagrams of FIGS. 4, 5 and 6.

Considering first FIG. 4, the mandrel 28 is shown separated from the sleeve 32 and the sleeve 32 separated from the clutch plate 39. In FIG. 2, the cut-out wall portions defining the channels 40 in the sleeve 32 will be evident. Further, the sector shaped radially extending lugs 36 on the end of the mandrel 28 are clearly shown. It will be understood that when the device is assembled, the lugs 36 are welded to the lower end of the mandrel 28 after the mandrel has been inserted through the sleeve 32. The arcuate extent of the lugs 36 is slightly less than the arcuate extent of the channels 40 so that these lugs can ride in the channels and be guided thereby during the telescoping movement. On the other hand, it will be appreciated that when the lugs 36 are in the relative position to the ends of the sleeve 32 illustrated in FIG. 4, they will underlie the ends of the sleeve 32 and thus lock the mandrel 28 from telescoping movement.

The sector shape of the cavity 37 cooperating with the clutch plate projections 38 will also be evident from FIG. 4. Essentially, these projections 38 of the clutch plate 39 act as stops to limit rotational movement of the mandrel 28 relative to the sleeve 32 to a given number of degrees. In the example illustrated, this given number of degrees is 90° and there are provided two radially extending lugs 36 on diametric opposite sides of the mandrel 28 and two channels in the sleeve 32 on diametrically opposite sides of the axis of the sleeve.

FIG. 5 is a schematic type cross section looking in the direction of the arrows 5—5 of FIG. 4 when the various components are assembled and in the first telescoped position wherein the lugs 36 underlie the lower ends of the sleeve 32. In this respect, the sleeve 32 is depicted by phantom lines in order that the lugs 36 will be visible. Also, the projections 38 are illustrated in dash lines in the cavity 37 abutting against end walls of the cavity.

When the mandrel is rotated 90° in the direction of the arrow 41 of FIG. 5 still viewing the same from the top, the lugs 36 will assume the positions illustrated in FIG. 6 wherein they are now free to move up the channels 40 of the sleeve 32. Also, it will be noted that the projections 38 now abut opposite walls of the sector cavity 37 thus serving as a stop so that the lugs 36 will be properly positioned for movement in the guide channels 40.

From the foregoing description, it will be evident that a right hand rotation through 90° of the sucker rods 24 of FIG. 1 will through the spider structure 23 rotate the plunger 20 and pump barrel 16 (the plunger 20 being keyed for longitudinal movement to the pump barrel 16. Rotation of the pump barrel 16 through the threaded connection at 17 to the upper threads 31 of the coupling 29 of the device illustrated in FIGS. 2 and 3 will thus rotate the mandrel 90° in a clockwise direction and thus position the lugs 36 as described in FIG. 6. However, there may be instances in which a customer utilizing the device may wish to effect a rotation 90° in an opposite direction in order to unlock the mandrel to operate the device. In this event, it is a simple matter simply to reverse the positions of the projections 38 of the clutch plate 39 shown in FIG. 5 so that they engage the opposite walls of the cut-out sector cavities 37 illustrated in FIG. 5. In this case, the mandrel will then be rotated 90° in a counter-clockwise direction and the projections 38 will thus function as a stop against the other sides of the cavity sectors 37. It will be appreciated, accordingly, that by rotating the clutch plate 39 to reposition the projections 38 at 90° to their original positions, the device may be made to operate by means of a counterclockwise rotation rather than a clockwise rotation. Torque spring 33 is reversed.

If for some reason the device should fail to operate and outward telescoping movement is prevented or in the event the lower end of the pump barrel 16 become stuck and it is desired to remove the pump unit and effect a hydraulic unloading, the coupling 29 illustrated in FIGS. 2 and 3 may be used. Thus, by exerting a clockwise rotational force on the pump barrel 16 of FIG. 1 by means of the sucker rods 24 beyond the 90° movement involved in rotating the mandrel 28 further high torque will result in unthreading of the left-hand threads 30 of the upper end of the mandrel 28 from the coupling 29. The resulting separation of the coupling 29 from the upper end of the mandrel 28 opens the upper end of the passage 28' to fluid in the pumping tube 14 and pipe string which fluid will then pass down the passage 28' to the well annulus the same as though the port 35 were exposed.

After the foregoing hydraulic unloading, the upper portion of the pumping unit may then be removed together with the coupling 29 and, subsequently, a suitable fishing tool lowered to engage the mandrel 28 and thence effect removal of the remaining portion of the tool.

OPERATION

The operation of the tool will be evident from the foregoing but may be summarized as follows:

Visualizing the device of FIG. 2 positioned in the joint 17 of FIG. 1, and with the mandrel 28 in its locked first telescoped position rotated such that the lugs 36 underlie the ends of the sleeve 32, it will be evident that normal pumping operations as heretofore described to remove the oil 13 to the surface of the bore hole can be carried out. It should be understood that the torque spring 33 biases the rotational position of the mandrel 28 of FIG. 2 to the telescoped locked rotated position shown.

If now it is desired to unseat the pump barrel 16 from the annular seat 15 at the inner lower end of the pumping tube 14, such unseating can be greatly facilitated by equalizing the hydrostatic pressure of the oil within the pumping tube 14 and pipe string with the hydrostatic pressure of the oil in the well annulus between the casing 11 and exterior of the pumping tube 14.

Thus, to effect the desired hydraulic hydrostatic pressure equalization, the sucker rods 24 are rotated 90° in a clockwise direction as viewed from above thereby rotating the mandrel 28 and moving the lugs 36 to the positions illustrated in FIG. 3 wherein they are received in the cut-out channels 40 of the sleeve 32. It will be noted that this rotational movement through 90° is opposed by the bias of the torque spring 33. However, once the projecting lugs 36 are received in the channels 40, the mandrel is held in its rotated position and upward movement of the mandrel can then take place to expose the port 35 when the mandrel is moved to its second telescoped position illustrated in FIG. 3.

With the port 35 exposed, hydraulic equalization will take place and the pump barrel can then easily be lifted from the annular seat 15 in the lower end of the pumping tube.

The device may be repositioned to that illustrated in FIG. 2 by simply lowering the mandrel 28 until the lugs 36 pass from the lower ends of the channels 40 at which point the torque spring 33 will bias the mandrel in a counterclockwise rotative direction to return the lugs to the position illustrated in FIG. 2 beneath the ends of the sleeve 32.

As mentioned heretofore, it is also evident that in the event the tool should become stuck, the fact that the device illustrated in FIGS. 2 and 3 may be separated as a consequence of the use of the coupling 29 with left hand threads enables removal of at least a portion of the tool. Fishing of the remaining portion is then greatly facilitated as a consequence of the exposed end of the mandrel being available for cooperation with the fishing tool.

I claim:

1. A hydraulic unloading and circulating device adapted to be inserted in a threaded joint of a well tool connected to sucker rods and including a pumping tube surrounding said tool and supported on the end of a pipe string through which said sucker rods extend, for passing fluid between the exterior of the tool and interior of the pumping tube to the interior of the tool so as to be placed in communication with the well annulus and thereby relieve the difference of hydrostatic pressure between fluid in the well annulus and fluid in the interior of the pumping tube and pipe string, said device comprising, in combination:

a. a housing having lower threads for threaded connection to the lower threads of said joint;

b. a mandrel having a lower end portion telescopically received in the upper portion of said housing, the upper end of said mandrel being coupled to the upper threads of said joint, said mandrel having a straight through central passage including a lateral port eclipsed by said housing when said mandrel is telescoped within said housing to a first given position, and exposed above said housing when said mandrel is pulled upwardly from said housing to a second telescoped position;

c. a sleeve in the lower portion of said housing having cut-out wall portions defining vertical guide channels of given circumferential width, the lower end of said mandrel being received in said sleeve and having radially extending lugs of given circumferential extent receivable in said channels so that upward and downward telescoping movement of said mandrel between said first and second telescoped positions is guided by said guide channels, the lower ends of said sleeve between said channels being spaced above the lower end of said mandrel when in said first telescoped position so that rotation of said mandrel through a given number of degrees positions said lugs beneath said lower ends of the sleeve to thereby lock the mandrel against pulling movement when in its rotated position; and d. a torque spring connected between said mandrel and said housing to exert a circumferentially directed biasing force on said mandrel in a rotational direction to position said lugs beneath said lower ends of the sleeve, whereby intentional rotation of the sucker rods from the surface of the well through said given number of degrees in a rotational direction opposite to the bias of said torque spring positions through the upper threaded coupling of the mandrel said lugs in said channels, and subsequent upward pulling on said sucker rods from the surface of said well move said mandrel to said second telescoped position thereby exposing said port and placing fluid in said pump tube and pipe string in communication with fluid in the annulus of the well to thereby equalize the hydrostatic pressure of the fluid, subsequent urging of said mandrel to its first telescoped position eclipsing said port and permitting rotation of the mandrel by said spring to its rotated position to lock the mandrel against telescoping movement relative to said housing.

2. The subject matter of claim 1, in which the upper end of said mandrel is coupled to the upper threads of said joint by means of a coupling having left hand threads on its lower end, said mandrel having left hand threads on its upper end to receive said coupling, the upper end of said coupling having right hand threads to receive said upper threads of said joint whereby the upper end of said straight through passage in said mandrel may be exposed by unthreading of said coupling therefrom upon rotation of the upper end of said tool in a right hand direction without loosening the remaining threaded joints in said device and tool.

3. A device according to claim 1, including a clutch means secured to the lower end of said housing and including upwardly directed projections, the extreme lower end of said mandrel having arcuate cavities receiving said projections, the arcuate extent of said cavities corresponding to said given number of degrees whereby said mandrel is limited in rotational movement when in said first telescoped position by abutment of said projections with the side walls of said cavity.

4. The subject matter of claim 3, in which said given number of degrees is 90°, the circumferential width of said channels being slightly greater than 90° and the circumferential width of said lugs being slightly less than 90°, the channels being defined by cut-outs on diametrically opposite sides of said sleeve and said lugs extending radially in diametrically opposite directions, the circumferential extend of said cavity being 90°, and said clutch means being repositionable 90° from its initial orientation such that the given direction of rotation through said given number of degrees may be reversed if so desired.

* * * * *